US010500839B2

(12) United States Patent
Sato et al.

(10) Patent No.: US 10,500,839 B2
(45) Date of Patent: Dec. 10, 2019

(54) INKJET PRINTING APPARATUS AND RELATED PRINTING METHOD IN WHICH A LIQUID APPLIED TO A TRANSFER MEMBER IS DRIED BEFORE INK IS DISCHARGED BY A PRINTHEAD

(71) Applicant: CANON KABUSHIKI KAISHA, Tokyo (JP)

(72) Inventors: Ryosuke Sato, Kawasaki (JP); Masato Izumi, Tokyo (JP); Kota Uchida, Kawasaki (JP); Kengo Nieda, Kawasaki (JP); Yusuke Nakaya, Inagi (JP); Kenji Sugiyama, Kawasaki (JP); Ippei Tsushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/906,296

(22) Filed: Feb. 27, 2018

(65) Prior Publication Data

US 2018/0250930 A1 Sep. 6, 2018

(30) Foreign Application Priority Data

Mar. 6, 2017 (JP) ..... 2017-042086

(51) Int. Cl.
*B41J 2/005* (2006.01)
*B41J 29/17* (2006.01)
*B41J 29/377* (2006.01)

(52) U.S. Cl.
CPC ..... *B41J 2/0057* (2013.01); *B41J 29/17* (2013.01); *B41J 29/377* (2013.01)

(58) Field of Classification Search
CPC ..... B41J 2/0057; B41J 29/377; B41J 29/17
See application file for complete search history.

(56) References Cited

U.S. PATENT DOCUMENTS 6,682,189 B2 1/2004 May et al.
6,767,092 B2 7/2004 May et al.
9,138,985 B1 † 9/2015 Yang
2013/0328989 A1 * 12/2013 Thayer ..... B41J 2/17593 347/206
2015/0267078 A1 † 9/2015 Dooley
2016/0332438 A1 * 11/2016 Takeuchi ..... B41M 5/0017
2018/0126726 A1 * 5/2018 Shmaiser ..... B41J 2/0057

FOREIGN PATENT DOCUMENTS

JP 2003-182064 A 7/2003
JP 2015155147 A * 8/2015

OTHER PUBLICATIONS

U.S. Appl. No. 15/906,156, Ryosuke Sato Yusuke Nakaya, filed Feb. 27, 2018.

* cited by examiner
† cited by third party

*Primary Examiner* — Sharon A. Polk
(74) *Attorney, Agent, or Firm* — Venable LLP

(57) ABSTRACT

An inkjet printing apparatus includes a printhead configured to form an image by discharging ink to a transfer member, a transfer unit configured to transfer the image from the transfer member to a print medium, and an application unit configured to apply a first liquid to the transfer member prior to formation of the image by the printhead. The inkjet printing apparatus also includes a first drying unit configured to dry the first liquid applied to the transfer member by the application unit by blowing air using a first air blower before the ink is discharged by the printhead to the transfer member.

20 Claims, 10 Drawing Sheets

INKJET PRINTING APPARATUS AND RELATED PRINTING METHOD IN WHICH A LIQUID APPLIED TO A TRANSFER MEMBER IS DRIED BEFORE INK IS DISCHARGED BY A PRINTHEAD

BACKGROUND OF THE INVENTION

Field of the Invention

The present invention relates to an inkjet printing apparatus and a related printing method, and, more particularly, to, for example, an inkjet printing apparatus and a related printing method that transfer an image, formed by discharging ink to an intermediate transfer member, to a print medium and print the image.

Description of the Related Art

Conventionally, printing apparatuses that perform printing in accordance with an inkjet method include a printing apparatus configured to discharge ink to an intermediate drum by a printhead, to form an image on the intermediate drum, to transfer the image to a print medium, and to print the image. For example, Japanese Patent Laid-Open No. 2003-182064 discloses an arrangement that includes an image forming unit using an inkjet printhead, an ink removal unit, a transfer processing unit, and the like, around an intermediate transfer member (also simply referred to as a transfer member), such as the intermediate drum.

More specifically, the image is formed by discharging the ink to the transfer member by the printhead. Then, an extra liquid is removed from the formed image by rotating the transfer member, and, after that, the formed image is heated, the transfer member is further rotated, and the image is transferred to the print medium at a transfer position. After the image transfer, the transfer member further rotates to remove remaining ink, restoring the state of the transfer member for the next image formation.

There is also known an arrangement that performs preprocessing for applying a preprocessing liquid or a liquid known as a reactive liquid to the transfer member in order to improve the quality of an image to be formed next in the restoration process.

In the prior art, however, there is not provided an arrangement that satisfactorily maintains the state of the preprocessing liquid applied to the transfer member. Therefore, if the preprocessing liquid that is high in liquid content is applied to the transfer member, or the preprocessing liquid is applied to the transfer member in a state in which a liquid remains in a previous step, the preprocessing liquid decreases in viscosity and does not sufficiently react with discharged ink in the next image formation. As a result, the formed image loses its high quality.

SUMMARY OF THE INVENTION

Accordingly, the present invention is conceived as a response to the above-described disadvantages of the conventional art.

For example, an inkjet printing apparatus and a related printing method according to this invention are capable of properly maintaining the state of a liquid applied to a transfer member for preprocessing and printing a high-quality image.

According to one aspect, the present invention provides an inkjet printing apparatus comprising a printhead configured to form an image by discharging ink to a transfer member, an application unit configured to apply a first liquid to the transfer member prior to formation of the image, and a first drying unit configured to dry the first liquid applied to the transfer member by the application unit.

According to another aspect, the present invention provides a printing method in an inkjet printing apparatus that forms an image by discharging ink from a printhead to a transfer member, and transfers the image from the transfer member to a print medium, the method comprising applying a first liquid to the transfer member prior to formation of the image, drying the liquid applied to the transfer member, and printing an image by discharging the ink from the printhead to the transfer member to which the liquid by the drying is applied.

The invention is particularly advantageous since it is possible to print the high-quality image.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings. Note that, in each drawing, arrows X and Y indicate horizontal directions perpendicular to each other, and an arrow Z indicates a up/down direction.

Description of Terms

In this specification, the terms "print" and "printing" not only include the formation of significant information, such as characters and graphics, but also broadly include the formation of images, figures, patterns, and the like, on a print medium, or the processing of the medium, regardless of whether they are significant or insignificant and regardless of whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (also referred to as a "liquid" hereafter) should be broadly interpreted to be similar to the definition of "print" described above. That is, "ink" includes a liquid that, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component. It is assumed, however, that this embodiment uses water-base ink including water, resin, and pigment serving as coloring material.

Further, a "print element (or nozzle)" generically means an ink orifice or a liquid channel communicating with the ink orifice, and an element for generating energy used to discharge ink, unless otherwise specified.

An element substrate for a printhead (head substrate), as used below, means not merely a base made of a silicon semiconductor, but an arrangement in which elements, wirings, and the like, are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process, or the like.

Printing System

Figure 1:
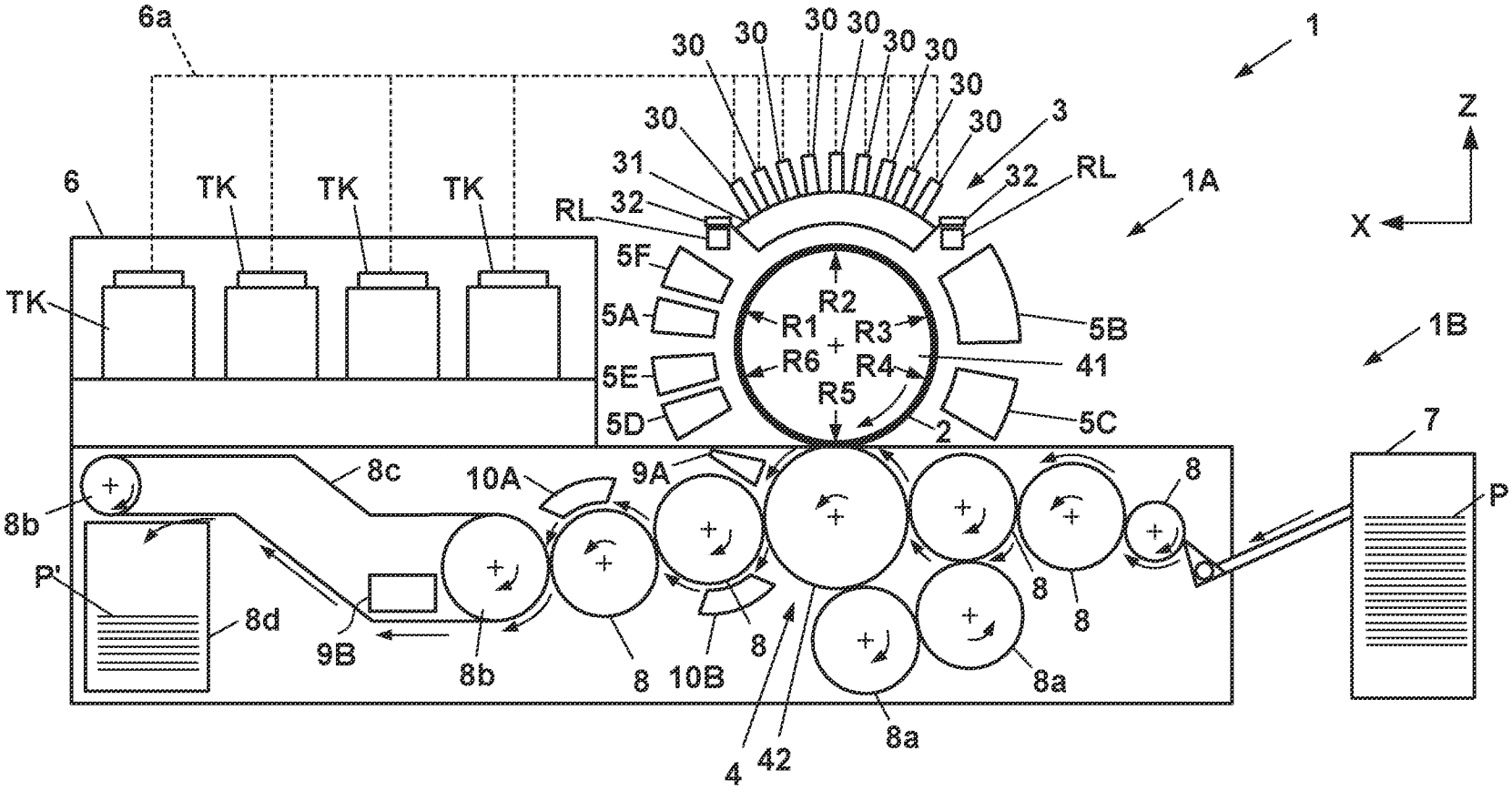
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Printing Apparatus

The printing apparatus 1A includes a print unit 3, a transfer unit 4, peripheral units 5A to 5F, and a supply unit 6.

Print Unit

Figure 2:
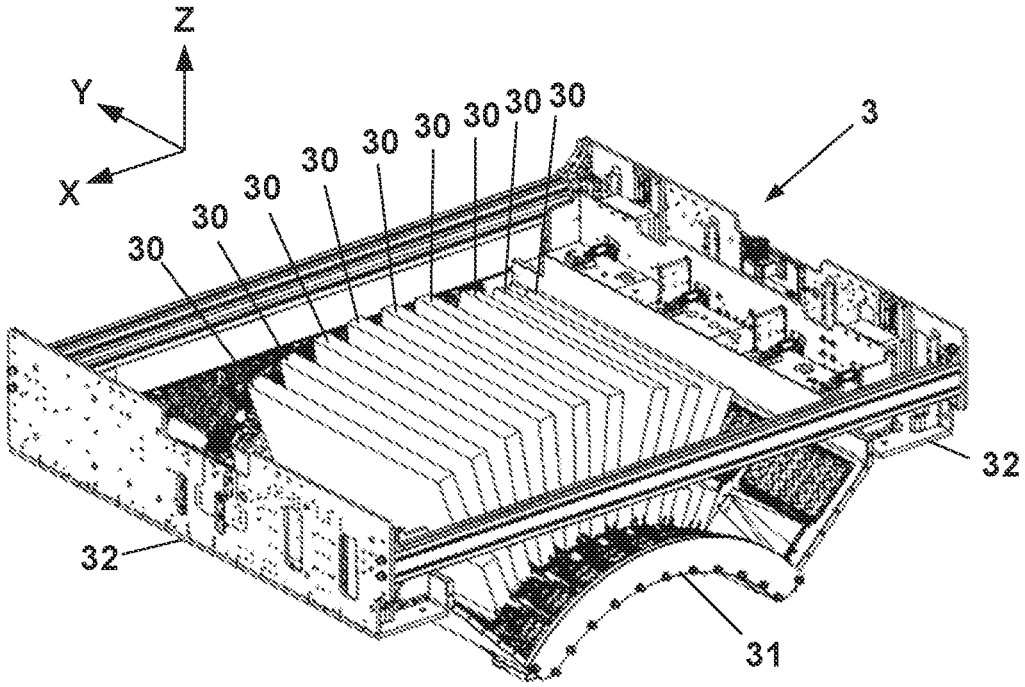
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range in which they cover the width of an image printing area of a print medium having a maximum usable size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus, the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like, can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. One printhead 30 may, however, be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
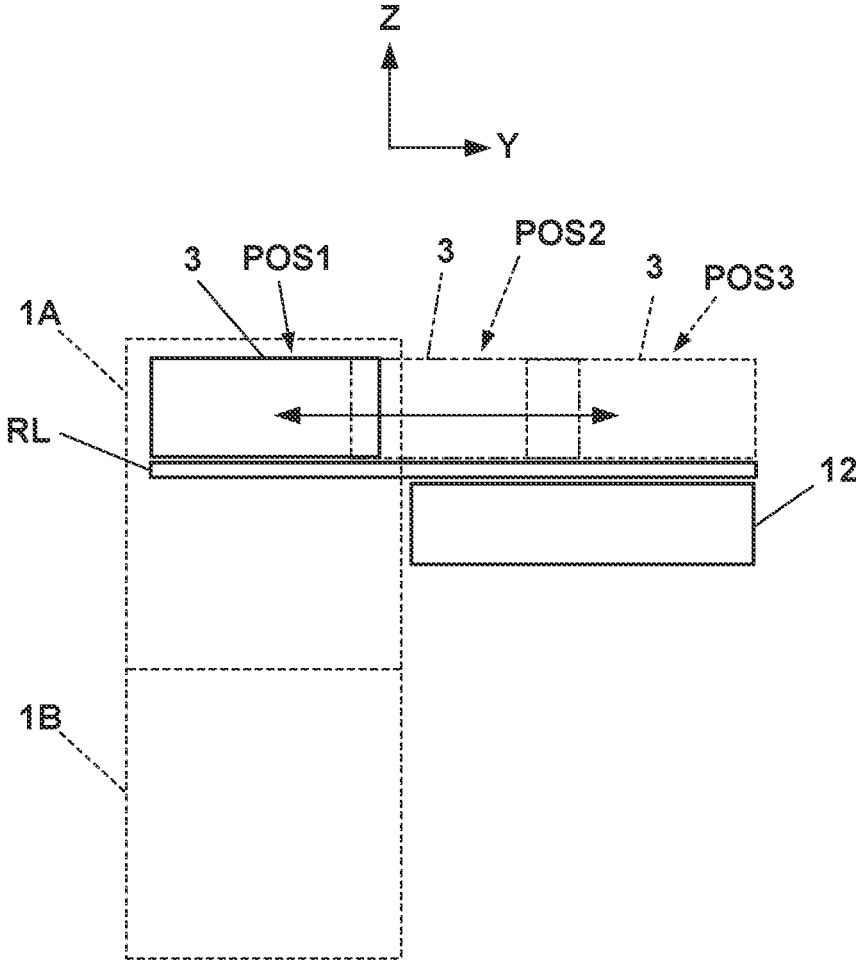
FIG. 3 is an explanatory view showing a displacement mode of the print unit shown in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism that caps the ink discharge surface of each printhead 30, a wiper mechanism that wipes the ink discharge surface, a suction mechanism that sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

Transfer Unit

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counter-clockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically in the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area in which preprocessing is performed on the transfer member 2 before the print unit 3 discharges ink and an area in which the peripheral unit 5A performs processing. In this embodiment, a reactive liquid is applied. The discharge area R2 is a formation area in which the print unit 3 forms an ink image by discharging ink to the transfer member 2. The processing areas R3 and R4 after discharge are processing areas in which processing is performed on the ink image after ink discharge. The processing area R3 after discharge is an area in which the peripheral unit 5B performs processing, and the processing area R4 after discharge is an area in which the peripheral unit 5C performs processing. The transfer area R5 is an area in which the transfer unit 4 transfers the ink image on the transfer member 2 to the print medium P. The processing area R6 after transfer is an area in which post processing is performed on the transfer member 2 after transfer and an area in which the peripheral unit 5D performs processing.

Note that the peripheral unit 5E is provided between the processing area R1 before discharge and the processing area R6 after transfer, and the transfer member 2 is cooled down by air blown from the peripheral unit 5E.

Also, the peripheral unit 5F is provided between the processing area R1 before discharge and the discharge area R2, and the reactive ink is dried and the transfer member 2 is cooled down by air blown from the peripheral unit 5F.

In this embodiment, the discharge area R2 is an area with a predetermined section. The other areas R1 and R3 to R6 have narrower sections than the discharge area R2. Comparing the areas to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer, or it may be an accumulative body of a plurality of layers. If the transfer member 2 is formed by the plurality of layers, it may include three layers of, for example, a surface layer, an elastic layer, and a compressed layer. The surface layer is an outermost layer having an image formation surface on which the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. In terms of durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of the treatments listed above may be combined. It is also possible to provide any desired surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, a vulcanizing accelerator, or the like, and further blending a foaming agent or a filling agent, such as hollow fine particles or salt, as needed. Consequently, a bubble portion is compressed along with a volume change with respect to various pressure fluctuations, and thus, deformation in directions other than a compression direction is small, making it possible to obtain a surface layer that is more stable in terms of transferability and durability. As the porous rubber material, there are a material having an open cell structure, in which respective pores continue to each other, and a material having a closed cell structure, in which the respective pores are independent of each other. Either structure may, however, be used, or both of these structures may be used.

As a member for the elastic layer, the various materials, such as the resin and the ceramic, can be used appropriately. In terms of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or to maintain resilience when attached to the transfer drum 41. Woven fabric may be used as the reinforce layer. The transfer member 2 can be manufactured by combining the respective layers formed by the materials described above in any desired manner.

The outer peripheral surface of the pressurizing drum 42 is pressed against the transfer member 2. At least one grip mechanism, which grips the leading edge portion of the print medium P, is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source, such as a motor that drives them. A driving force can be delivered by a transmission mechanism, such as a gear mechanism.

Peripheral Unit

The peripheral units 5A to 5F are arranged around the transfer drum 41. In this embodiment, the peripheral units 5A to 5F are specifically an application unit, an absorption unit, a heating unit, a cleaning unit, a cooling unit, and a drying unit, in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like, that form the ink react chemically or suck physically by contacting the component that increases the ink viscosity, recognizing the increase in ink viscosity. This increase in ink viscosity includes not only a case in which an increase in viscosity of an entirety of the ink is recognized, but also a case in which a local increase in viscosity is generated by coagulating some of the components, such as the coloring material and the resin that form the ink.

The component that increases the ink viscosity can use, without particular limitation, a substance, such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be used as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid component, such as a coloring material or a resin, included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and may run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or less than 10 μm in order to suppress adherence of an ink solid component to the liquid absorbing member. The pore size here refers to an average diameter and can be measured by a known means, such as a mercury intrusion technique, a nitrogen adsorption method, a scanning electron microscope (SEM) image observation, or the like. Note that the liquid component does not have a fixed shape, and is not particularly limited if it has fluidity and an almost constant volume. For example, water, an organic solvent, or the like, contained in the ink or reactive liquid can be given as the liquid component.

The heating unit 5C is a mechanism that heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method, such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps, such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like, as needed. A known shape, such as a roller shape or a web shape, can be used for a cleaning member used for cleaning.

The cooling unit 5E is a mechanism that cools down the transfer member 2 that was cleaned by the cleaning unit 5D, by blowing air. As described later, an amount of air blown is controlled by temperatures detected by a plurality of temperature sensors provided around the transfer member 2. By this arrangement, the cooling effect is controlled.

The drying unit 5F is an air blowing mechanism that dries the reactive liquid that was applied to the transfer member 2 by the application unit 5A, by blowing air. By this arrangement, a liquid component of the reactive liquid applied to the transfer member 2 evaporates to some extent, and the viscosity of the reactive liquid increases. Note that, as described later, an amount of air blown is controlled by a temperature of a temperature sensor provided at a downstream side of a rotation direction of the transfer member 2.

As described above, in this embodiment, the application unit 5A, the absorption unit 5B, the heating unit 5C, the cleaning unit 5D, the cooling unit 5E, and the drying unit 5F are included as the peripheral units. The invention is not, however, limited to this arrangement in which separate units, as shown in FIG. 1, are provided. For example, equivalent cooling functions of the cooling unit 5E for the transfer member 2 may be added to the application unit 5A or the cleaning unit 5D. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2, such that the temperature of the discharged ink is maintained below the boiling point of water.

In addition to the air blowing mechanism, a mechanism that brings a member (for example, a roller) into contact with the transfer member 2 and cools this member by the air blowing mechanism may be provided to the cooling unit 5E. Another mechanism that cools the cleaning member of the cleaning unit 5D may be provided to the cooling unit 5E. A cooling timing may be a period before application of the reactive liquid after transfer.

Supply Unit

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Conveyance Apparatus

The conveyance apparatus 1B is an apparatus that feeds the print medium P to the transfer unit 4 and discharges, from the transfer unit 4, the printed product P to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit in which the plurality of print media P are stacked and a feeding mechanism that feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism that grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side, but is transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket 8*b*. The chain 8*c* includes a plurality of grip mechanisms spaced apart from each other in its longitudinal direction. Each grip mechanism grips the end of the printed product P'. The printed product P is transferred from the conveyance drum 8 positioned at a downstream end to each grip mechanism of the chain 8*c*, and the printed product P' gripped by the grip mechanism is conveyed to the collection unit 8*d* by running the chain 8*c*, and releasing gripping. Consequently, the printed product P' is stacked in the collection unit 8*d*.

Post Processing Unit

The conveyance apparatus 1B includes post processing units 10A and 10B. The post processing units 10A and 10B are mechanisms that are arranged on the downstream side of the transfer unit 4, and perform post processing on the printed product P'. The post processing unit 10A performs processing on the obverse surface of the printed product P, and the post processing unit 10B performs processing on the reverse surface of the printed product P'. The contents of the post processing includes, for example, coating that aims at protection, glossy, and the like, of an image on the image printed surface of the printed product P'. For example, liquid application, sheet welding, lamination, and the like, can be used as an example of coating.

Inspection Unit

The conveyance apparatus 1B includes inspection units 9A and 9B. The inspection units 9A and 9B are mechanisms that are arranged on the downstream side of the transfer unit 4, and inspect the printed product P'.

In this embodiment, the inspection unit 9A is an image capturing apparatus that captures an image printed on the printed product P' and includes an image sensor, for example, a charge coupled device (CCD) sensor, a complementary metal oxide semiconductor (CMOS) sensor, or the like. The inspection unit 9A captures a printed image while a printing operation is performed continuously. Based on the image captured by the inspection unit 9A, it is possible to confirm a temporal change in tint, or the like, of the printed image and to determine whether to correct image data or to print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images for every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P.

Control Unit

Figure 4:
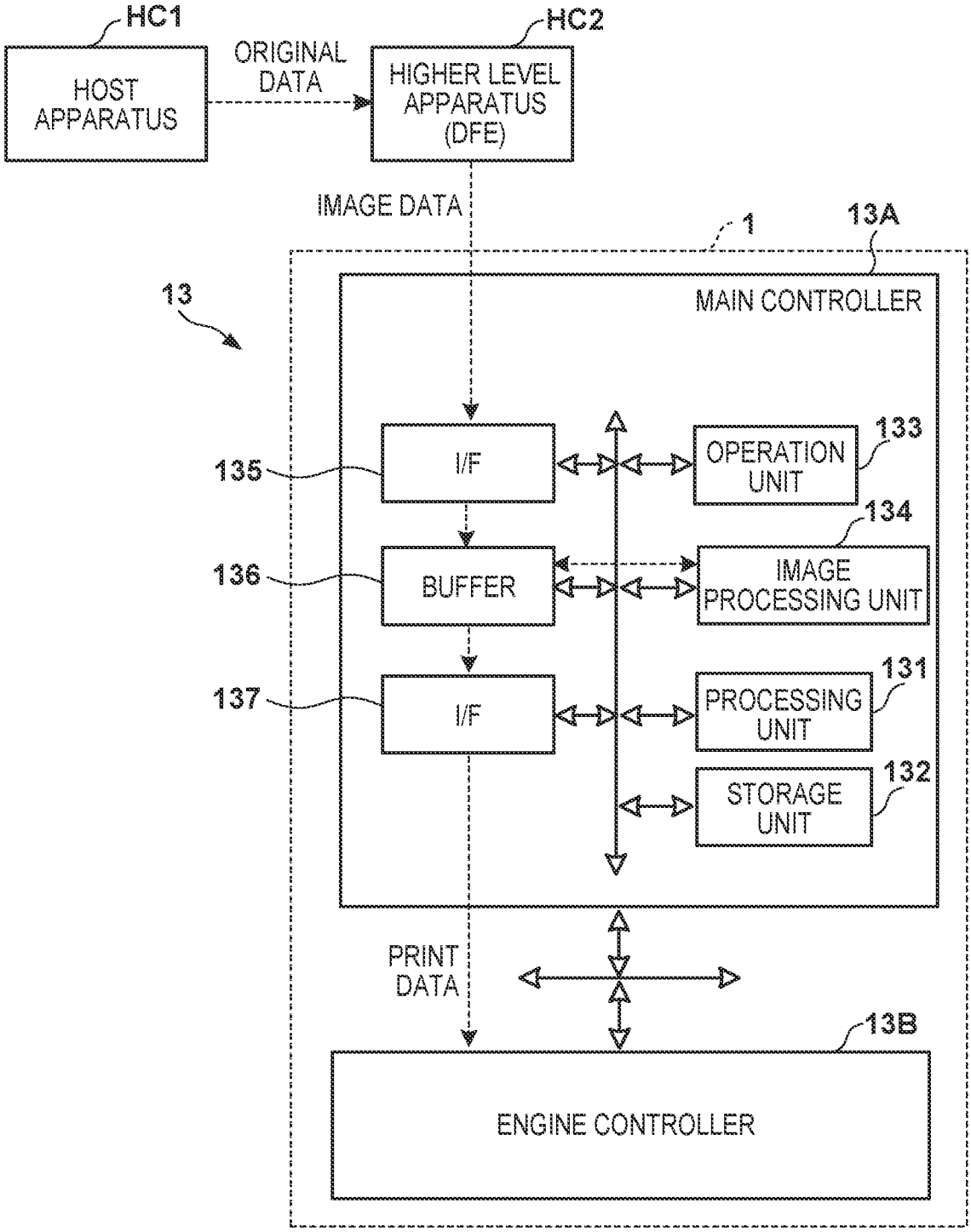
FIG. 4 is a block diagram showing a control system of the printing system shown in FIG. 1.
Figure 5:
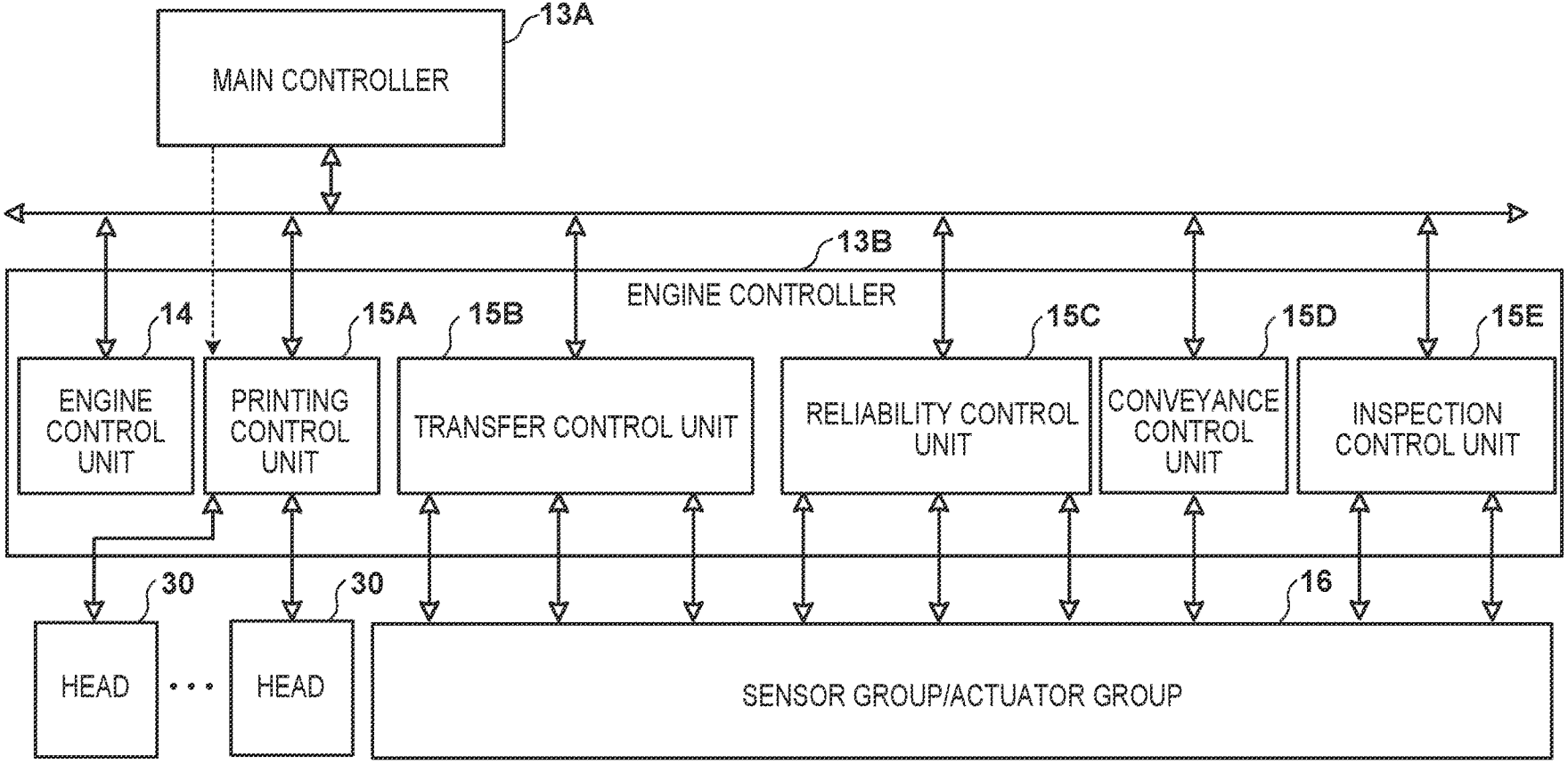
FIG. 5 is a block diagram showing the control system of the printing system shown in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a personal computer (PC) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file, such as a document file or an image file. This original data is transmitted to the higher level apparatus HC2. In the higher level apparatus HC2, the received original data is converted into a data format (for example, red-green-blue (RGB) data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor, such as a central processing unit (CPU), executes programs stored in the storage unit 132, and controls the entire main controller 13A. The storage unit 132 is a storage device, such as a random access memory (RAM), a read only memory (ROM), a hard disk, or a solid state drive (SSD), stores data and the programs executed by the processing unit 131, and provides the processing unit (CPU) 131 with a work area. An external storage unit may further be provided in addition to the storage unit 132. The operation unit 133 is, for example, an input device, such as a touch panel, a keyboard, or a mouse, and accepts a user instruction. The operation unit 133 may be formed by an input unit and a display unit that are integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication IF 135 communicates with the higher level apparatus HC2, and the communication IF 137 communicates with the engine controller 13B. In FIG. 4, broken-line arrows exemplify the processing sequence of image data. Image data received from the higher level apparatus HC2 via the communication IF 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor, such as a CPU, a storage device, such as a RAM or a ROM, and an interface with an external device. Note that the division of the control units is merely illustrative, and a plurality of subdivided control units may perform some of control operations or, conversely, the plurality of control units may be integrated with each other, and one control unit may be configured to implement their control contents.

The engine control unit 14 controls the entire engine controller 13B. The printing control unit 15A converts print data received from the main controller 13A into raster data, or the like, in a data format suitable for driving of the printheads 30. The printing control unit 15A controls discharge of each printhead 30.

The transfer control unit 15B controls the application unit 5A, the drying unit 5F, the absorption unit 5B, the heating unit 5C, the cleaning unit 5D, and the cooling unit 5E.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
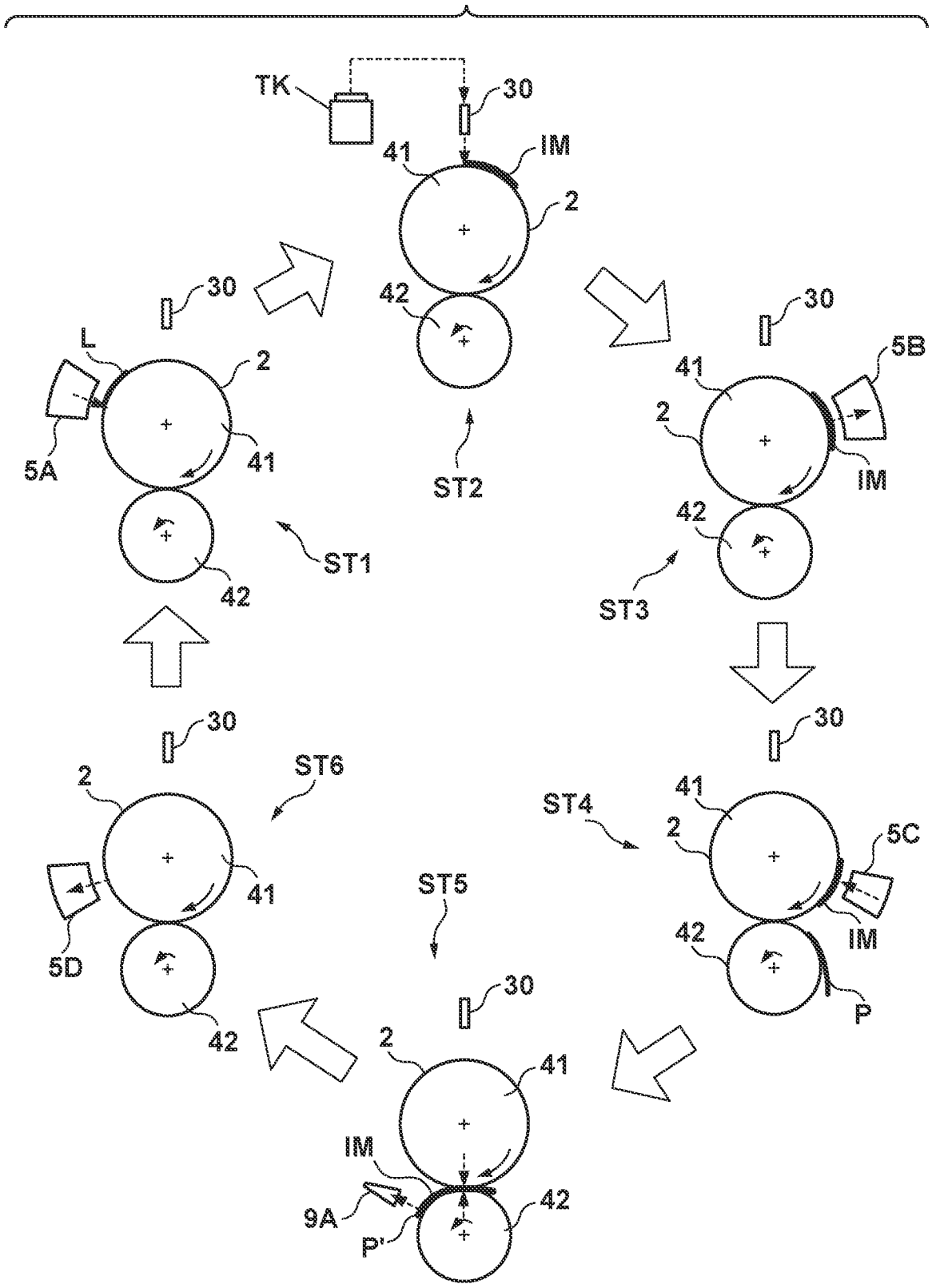
FIG. 6 is an explanatory view showing an example of the operation of the printing system shown in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied and dries up by the drying unit 5F moves along with the rotation of the transfer drum 41. When the portion to which the reactive liquid L is applied reaches a position under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. Note that the surface of the transfer member 2 is sufficiently cooled down by the cooling unit before the state of the transfer member 2 returns to the state ST1 from the state ST6. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
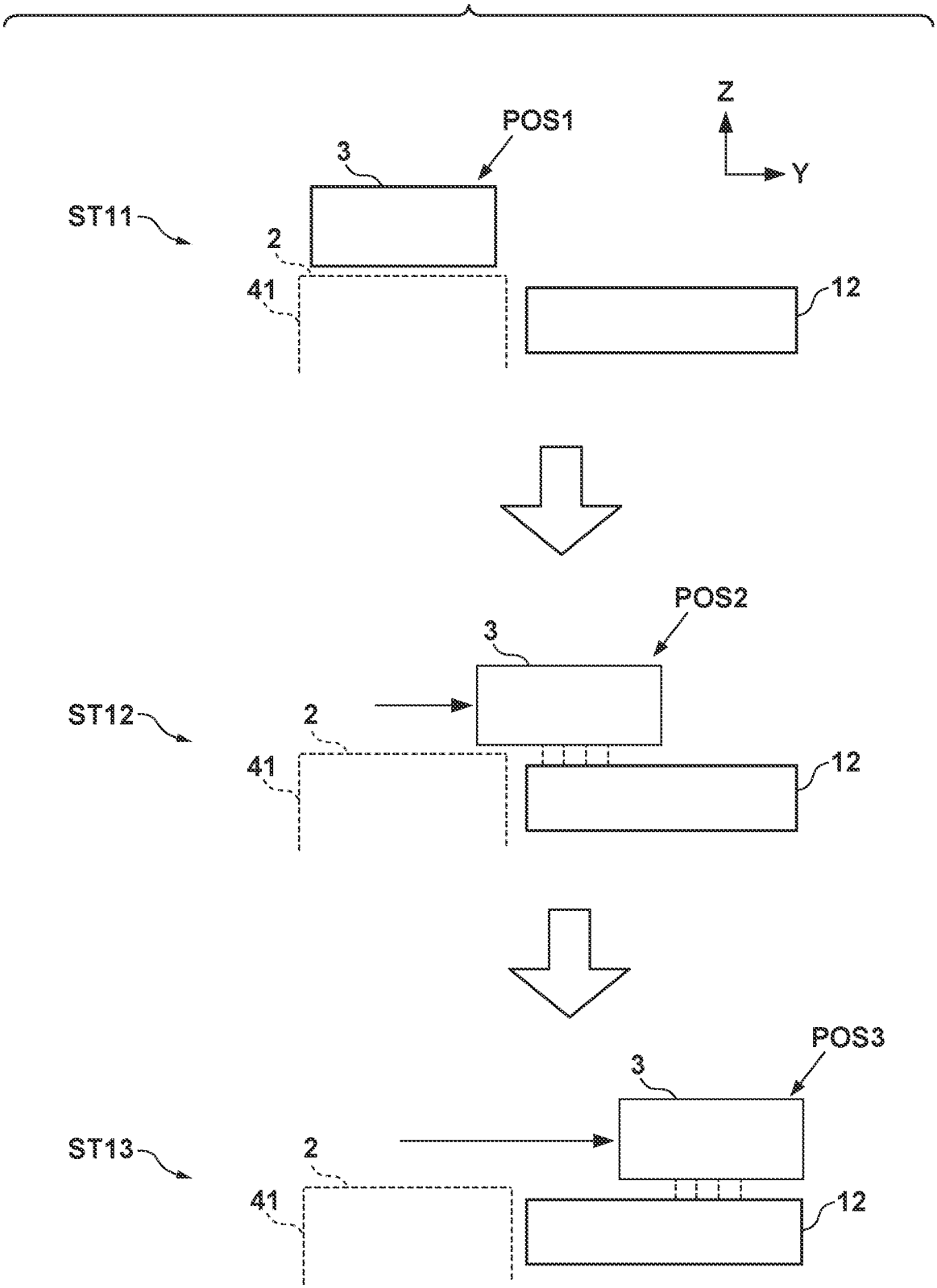
FIG. 7 is an explanatory view showing an example of the operation of the printing system shown in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. During passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

Control of effectively cooling and heating the transfer member 2, and properly maintaining the temperature of the transfer member 2 in the printing system having the above arrangement will be described next.

Temperature Control of Transfer Member

Figure 8:
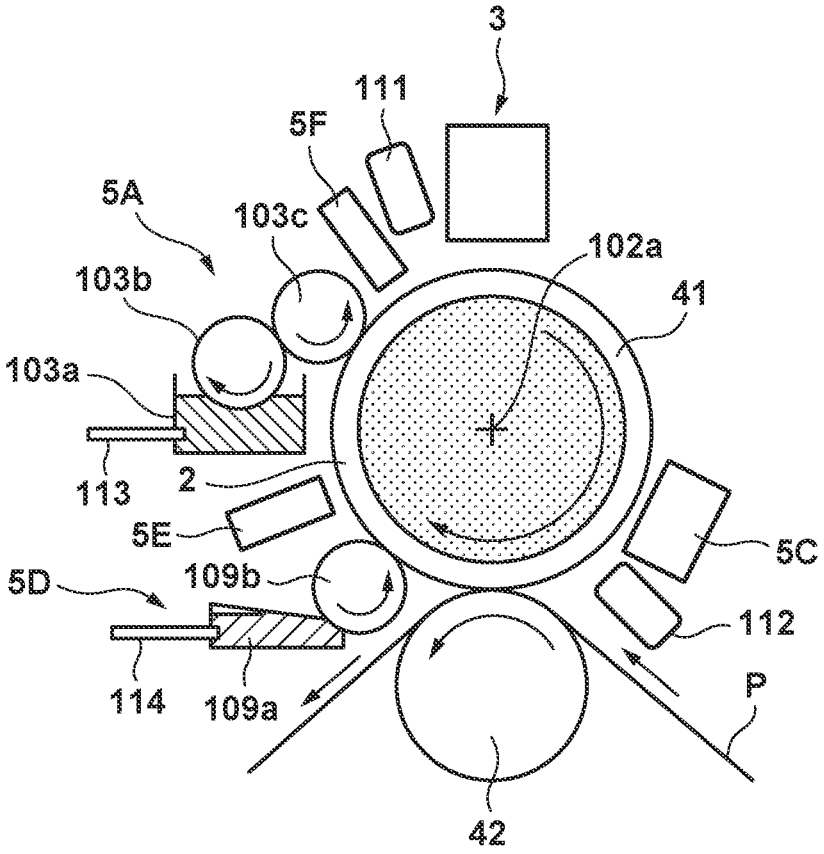
FIG. 8 is an explanatory view showing constituent elements provided around the transfer member to perform high quality image formation.

FIG. 8 is a view schematically showing constituent elements provided around the transfer member 2 in order to perform temperature control of the transfer member 2. Note that in FIG. 8, out of the various constituent elements of the printing system shown in FIG. 1, portions that are not directly related to the temperature control of the transfer member 2 are not illustrated. Also in FIG. 8, the same reference numerals denote the constituent elements that have already been described with reference to FIG. 1, and a description thereof will not be repeated.

As shown in FIG. 8, concerning the rotation direction of the transfer member 2, a temperature sensor 111 is provided on the downstream side of the drying unit 5F, and a temperature sensor 112 is provided on the downstream side of the heating unit 5C. By thus arranging the two temperature sensors, the temperature of the transfer member 2 cooled by the cooling unit 5E, the application unit 5A, and the drying unit 5F is detected, and the temperature of the transfer member 2 heated by the heating unit 5C is detected. Each of the temperature sensors 111 and 112 is a non-contact type sensor that detects the temperature of the transfer member 2 by detecting infrared rays radiated from the surface of the transfer member 2.

With such an arrangement, the temperature of the transfer member 2 is maintained relatively low immediately below the print unit 3 and maintained relatively high in the nip portion between the transfer drum 41 to which an image is transferred and the pressurizing drum 42.

The application unit 5A includes a reactive liquid container 103*a* that contains the reactive liquid L applied to the transfer member 2, a roller 103*b* that extracts the reactive liquid L contained in the reactive liquid container 103*a*, and a roller 103*c* that applies the reactive liquid L impregnated in the roller 103*b* to the transfer member 2. The reactive liquid container 103*a* includes a cooling mechanism that cools the reactive liquid L to a predetermined temperature or lower and maintains that temperature. The reactive liquid container 103*a* includes a temperature sensor 113 that measures the temperature of the reactive liquid L.

The cleaning unit 5D includes a cleaning liquid (CL liquid) container 109*a* that contains a CL liquid used to clean the transfer member 2 and a roller 109*b* that applies the CL liquid contained there to the transfer member 2. The CL liquid container 109*a* includes a cooling mechanism that cools the CL liquid to a predetermined temperature or lower and maintains that temperature. The CL liquid container 109*a* includes a temperature sensor 114 that measures the temperature of the CL liquid.

As can be seen in the above arrangement, the transfer member 2 is cooled to some extent by applying the reactive liquid L with the application unit 5A and applying the CL liquid with the cleaning unit 5D. Therefore, it can be said that the application unit 5A and the cleaning unit 5D include liquid-cooled cooling functions.

In addition to this, as described above, the cooling unit 5E is provided between the application unit 5A and the cleaning unit 5D. The cooling unit 5E includes a fan that blows air to the transfer member 2 and a control unit that controls the air blowing amount. The drying unit 5F is further provided between the application unit 5A and the print unit 3. The drying unit 5F includes a fan that blows air to the transfer member 2 and a control unit that controls the air blowing amount.

Therefore, it can be said that the cooling unit 5E and the drying unit 5F in this embodiment include air-cooled cooling functions. In particular, an amount of air blown by the drying unit 5F is controlled in accordance with the temperature of the transfer member 2 detected by the temperature sensor 111, and, if the temperature is high and does not become low immediately below the print unit 3, the amount of air blown is increased to enhance its air-cooling capability. This makes it possible to promote drying of the reactive liquid applied to the transfer member 2 to increase a viscosity sufficiently, and to control the cooling temperature of the transfer member.

Figure 9:
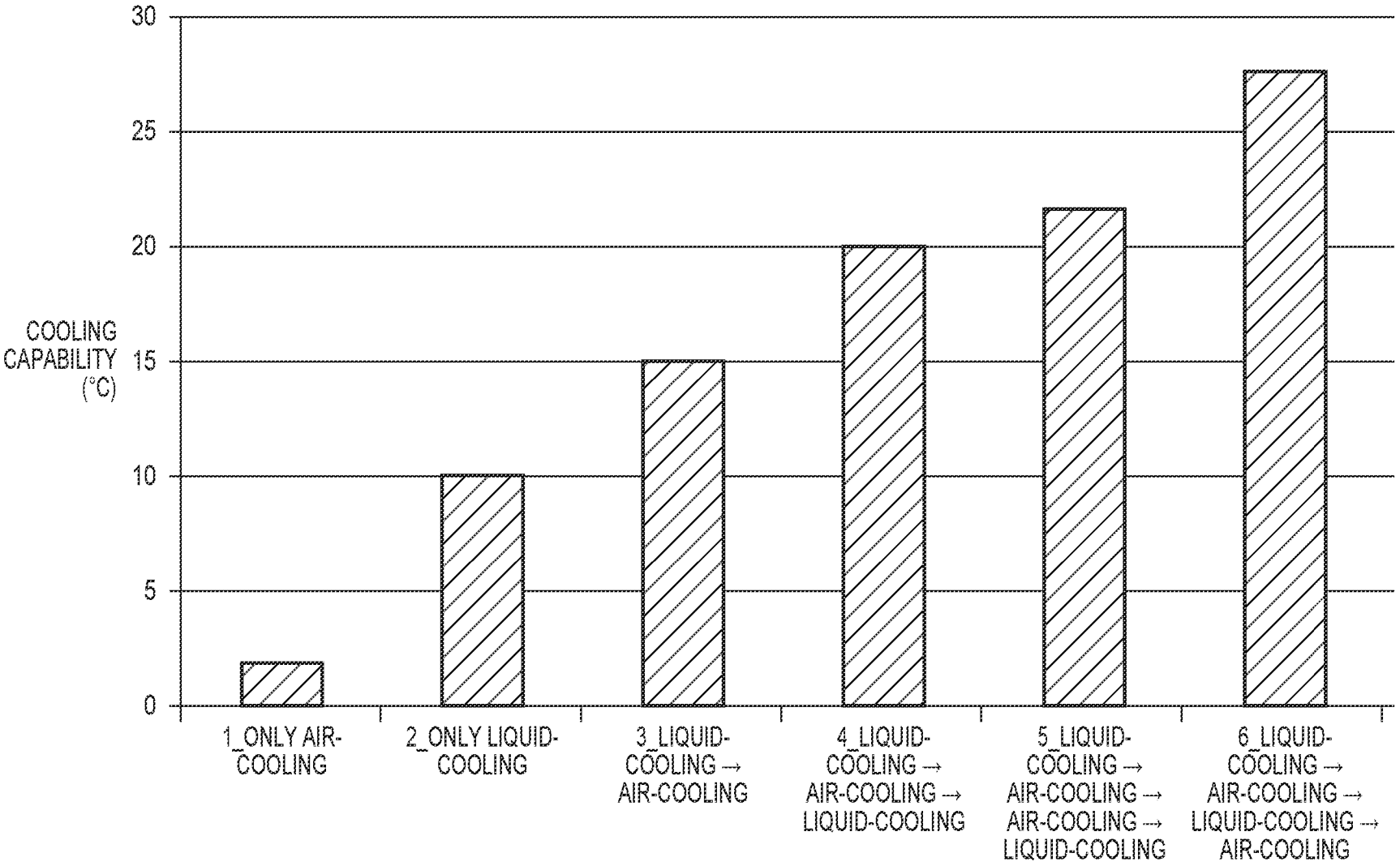
FIG. 9 is a comparison figure of cooling capability.

FIG. 9 is a comparative graph of cooling capabilities.

FIG. 9 shows comparison of general cooling capabilities when the transfer member 2 is cooled by using six cooling methods. The cooling capabilities are indicated by cooling temperatures here. The methods are 1_air-cooling (air blower), 2_liquid-cooling (water), 3_liquid-cooling (water)→air-cooling (air blower), and 4_liquid-cooling (water)→air-cooling→liquid-cooling (water) from the left. Furthermore, the methods are 5_liquid-cooling (water)→air-cooling (air blower)→air-cooling (air blower)→liquid-cooling (water) and 6_liquid-cooling (water)→air-cooling (air blower)→liquid-cooling (water)→air-cooling (air blower).

As described above, the printing system in this embodiment includes a cooling mechanism that cools the transfer member 2 in the sequence of liquid-cooling (CL liquid), air-cooling (CL liquid drying by air blower), liquid-cooling (RCT liquid), and air-cooling (RCT liquid drying by air blower) concerning the rotation direction of the transfer member 2. As also indicated from FIG. 9, such a sequence is determined in order to achieve an efficient cooling effect on the transfer member 2.

Figure 10:
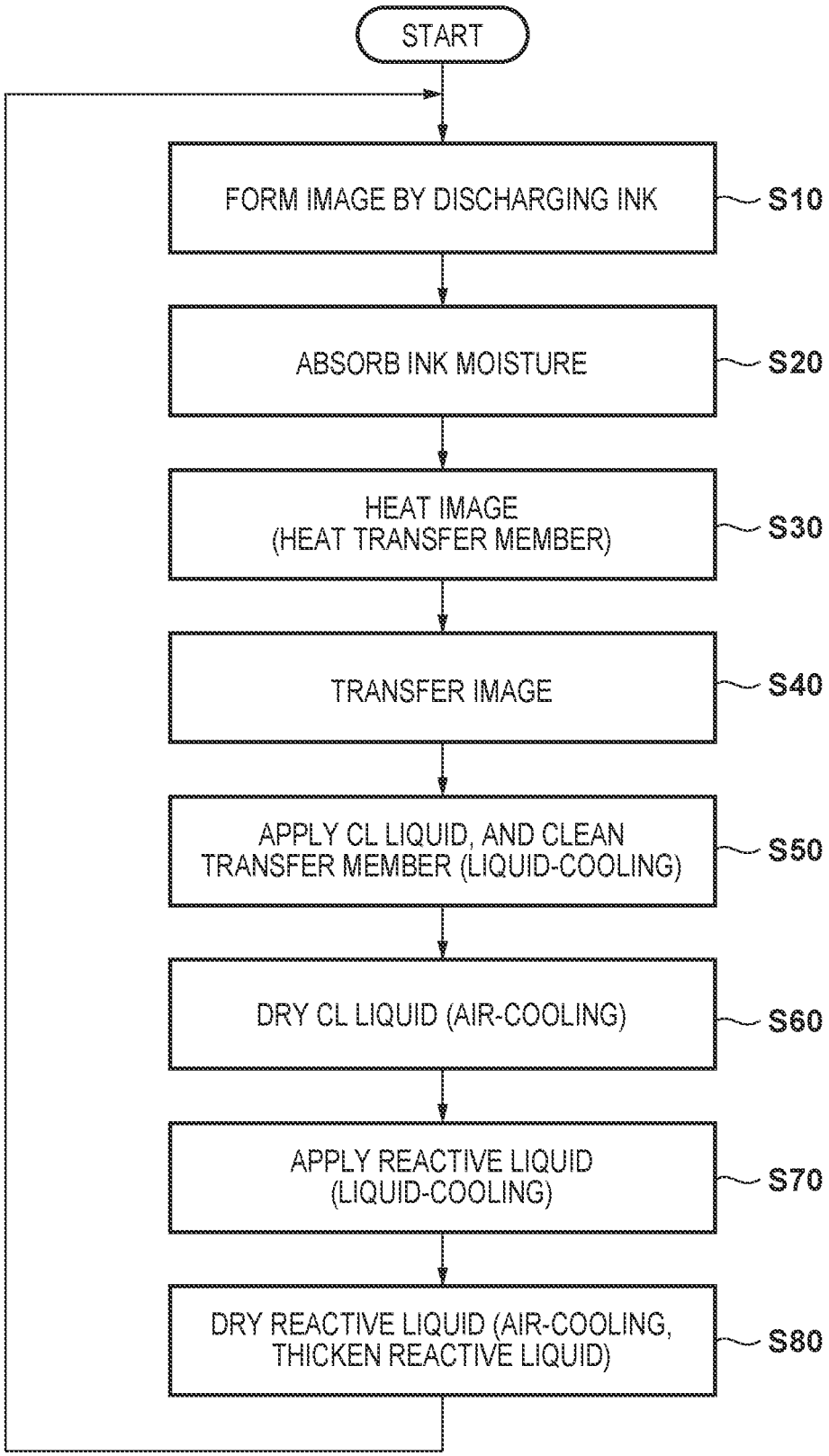
FIG. 10 is a flowchart showing a continuous image formation process performed by the printing system.

FIG. 10 is a flowchart showing a continuous image formation process performed by the printing system.

As described above, the print unit 3 with the printheads 30, the absorption unit 5B, the heating unit 5C, the transfer unit 4, the cleaning unit 5D, the cooling unit 5E, the application unit 5A, and the drying unit 5F are provided in order around the transfer member 2. It is therefore possible to continuously print images on print media by performing processing steps as follows in accordance with the rotation of the transfer member 2.

First, in step S10, an image is formed on the transfer member 2 by discharging ink from the printheads 30. Next, in step S20, the absorption unit 5B absorbs an extra liquid component from the image formed on the transfer member 2. Furthermore, the heating unit 5C heats the image formed on the transfer member 2 in step S30, and the transfer unit 4 transfers the image to a conveyed print medium in step S40.

In step S50, the cleaning unit 5D applies a cleaning liquid (CL liquid) to the transfer member 2 and cleans the transfer member 2. As described above, the CL liquid is held while being cooled to the predetermined temperature or lower, and thus the temperature of the transfer member 2 is decreased (liquid-cooled) by cleaning with the CL liquid. Furthermore, in step S60, the CL liquid remaining in the transfer member 2 is dried by air blown with the cooling unit 5E. Consequently, the temperature of the transfer member 2 is further decreased (air-cooled).

The surface of the transfer member 2 is thus dried, improving the application properties of the reactive liquid in the next step.

In step S70, the application unit 5A applies the reactive liquid to the transfer member 2. As described above, the reactive liquid is held while being cooled to the predetermined temperature or lower, and thus, the temperature of the transfer member 2 is further decreased (liquid-cooled) by cleaning with the reactive liquid. Furthermore, in step S80, the reactive liquid applied to the transfer member 2 is dried by air blown with the drying unit 5F. Consequently, the temperature of the transfer member 2 is further decreased (air-cooled), and the viscosity of the reactive liquid is increased by the temperature decrease.

In image formation of the next process, an increase in viscosity of the reactive liquid can promote a reaction with the ink discharged by the printheads 30, fix the ink immediately, and further suppress bleeding in which adjacent inks are mixed. This contributes to an improvement in quality of the formed image.

In the above-described manner, it becomes possible to apply the reactive liquid to the transfer member in a satisfactory state so that a high-quality image can be formed prior to image formation of the next process. Considering such a role of the reactive liquid, in general, the reactive liquid can also be referred to as a preprocessing liquid for the improvement in quality of the formed image.

Therefore, according to the above-described embodiment, it is possible to achieve both effective cooling of the transfer member and an increase in viscosity of the reactive liquid applied to the transfer member, and to form a high-quality image.

Another Embodiment

In the above embodiment, the print unit 3 includes the plurality of printheads 30. A print unit 3 may, however, include one printhead 30. For example, the printhead 30 may be of a serial type that forms an ink image while scanning a carriage to which the printhead 30 is detachably mounted in a Y direction, and discharging ink from the printhead 30.

A conveyance mechanism of the print medium P may adopt another method, such as a method of clipping and conveying the print medium P by the pair of rollers. In the method of conveying the print medium P by the pair of rollers, or the like, a roll sheet may be used as the print medium P, and a printed product P' may be formed by cutting the roll sheet after transfer.

In the above embodiment, the transfer member 2 is provided on the outer peripheral surface of the transfer drum 41. Another method, such as a method of forming a transfer member 2 into an endless swath and running it cyclically, may, however, be used.

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random access memory (RAM), a read only memory (ROM), a storage of distributed computing systems, an optical disk (such as a compact disc (CD), a digital versatile disc (DVD), or a Blu-ray Disc (BD)®), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-042086, filed Mar. 6, 2017, which is hereby incorporated by reference herein in its entirety.

What is claimed is:

1. An inkjet printing apparatus comprising:

a transfer member configured to move cyclically in a circular orbit;

a printhead configured to form an image on the transfer member by discharging ink to the transfer member;

a transfer unit configured to transfer the image from the transfer member to a print medium by rotating the transfer member;

an application unit configured to apply a first liquid to the transfer member prior to formation of the image by the printhead;

a first cooling unit configured to cool the first liquid before applying the first liquid by the application unit; and a first drying unit configured to dry the first liquid applied to the transfer member by the application unit before the ink is discharged by the printhead to the transfer member.

2. The apparatus according to claim 1, further comprising:

a cleaning unit configured to clean the transfer member, after the image is transferred to the print medium, by applying a second liquid to the transfer member; and a second drying unit configured to dry the second liquid, applied in order to clean the transfer member by the cleaning unit.

3. The apparatus according to claim 2, further comprising a second cooling unit configured to cool the second liquid, wherein the transfer member is cooled by the first liquid cooled by the first cooling unit, and the transfer member is cooled by the second liquid cooled by the second cooling unit.

4. The apparatus according to claim 3, wherein the second drying unit dries the second liquid using air blown by an air blower.

5. The apparatus according to claim 2, wherein the first liquid is a reactive liquid applied before the image is formed on the transfer member by the printhead, and is produced to react with the ink discharged from the printhead, and the second liquid is a cleaning liquid used in order to clean a surface of the transfer member after the image is transferred to the print medium.

6. The apparatus according to claim 5, wherein a viscosity of the reactive liquid is increased due to drying by the first drying unit.

7. The apparatus according to claim 5, wherein the ink contains a pigment as a color material, a resin, and a liquid component, and the reactive liquid reacts with the color material and the resin of the ink, and increases a viscosity of the ink.

8. The apparatus according to claim 2, further comprising a heating unit configured to heat the transfer member on which the image is formed, wherein the transfer unit transfers the image to the print medium after heating by the heating unit.

9. The apparatus according to claim 8, wherein the transfer member is a rotating member configured to rotate about a predetermined rotation axis, and a surface of the transfer member is configured to move cyclically in the circular orbit by rotating, and, along the circular orbit, the heating unit, the transfer unit, the cleaning unit, the second drying unit, the application unit, the first drying unit, and the printhead are arranged, in order, around the transfer member, in a rotation direction of the transfer member.

10. The apparatus according to claim 8, wherein, after the image is transferred to the print medium, in accordance with rotation of the transfer member, the transfer member is liquid-cooled by the cleaning unit, air-cooled by the second drying unit, liquid-cooled by the application unit, and air-cooled by the first drying unit.

11. The apparatus according to claim 1, further comprising a measurement unit configured to measure a temperature of the transfer member, wherein an air volume of air blown by an air blower, used for drying the first liquid, is controlled based on the temperature measured by the measurement unit, such that, when the detected temperature of the transfer member is relatively high, the air volume of the air blown is increased.

12. The apparatus according to claim 1, wherein the first cooling unit includes a container containing a reactive liquid applied to the transfer member, and the container cools and holds the reactive liquid to a predetermined temperature or lower.

13. The apparatus according to claim 12, wherein the application unit includes a first roller that extracts the reactive liquid contained in the container, and a second roller that applies the reactive liquid impregnated in the first roller to the transfer member.

14. The apparatus according to claim 1, wherein the first drying unit dries the first liquid applied to the transfer member by blowing air using an air blower.

15. A printing method in an inkjet printing apparatus that forms an image by discharging ink from a printhead to a transfer member configured to move cyclically in a circular orbit, and transfers the image from the transfer member to a print medium, the method comprising:

cooling a first liquid by a first cooling mechanism;

applying the first liquid to the transfer member prior to formation of the image;

drying the first liquid applied to the transfer member, before the ink is discharged by the printhead to the transfer member;

printing the image by discharging the ink from the printhead to the transfer member to which the first liquid has been applied and dried; and transferring the image from the transfer member to the print medium by rotating the transfer member.

16. The method according to claim 15, further comprising:

cleaning the transfer member, after the image is transferred to the print medium, by applying a second liquid to the transfer member; and drying the second liquid, applied in order to clean the transfer member.

17. The method according to claim 16, further comprising cooling the transfer member by the second liquid cooled by a second cooling mechanism.

18. The method according to claim 17, wherein the second liquid is dried using air blown by an air blower.

19. The method according to claim 16, further comprising heating the transfer member on which the image is formed, wherein the image is transferred to the print medium after the heating.

20. The method according to claim 19, wherein the transfer member is a rotating member configured to rotate about a predetermined rotation axis, and, after the image is transferred to the print medium, in accordance with rotation of the transfer member, the transfer member is liquid-cooled by the cleaning, air-cooled by the drying of the second liquid, liquid-cooled by the applying of the first liquid, and air-cooled by the drying of the first liquid.

* * * * *